US012428216B1

(12) United States Patent
Zhang

(10) Patent No.: US 12,428,216 B1
(45) Date of Patent: Sep. 30, 2025

(54) PIZZA CONTAINER

(71) Applicant: Shenzhen Huamingjun Rubber Co., Ltd, Guangdong (CN)

(72) Inventor: Hongjun Zhang, Guangdong (CN)

( * ) Notice: Subject to any disclaimer, the term of this patent is extended or adjusted under 35 U.S.C. 154(b) by 0 days.

(21) Appl. No.: 18/929,680

(22) Filed: Oct. 29, 2024

(30) Foreign Application Priority Data

Jun. 26, 2024 (CN) ..... 202421494278.4

(51) Int. Cl.
*B65D 85/36* (2006.01)
*B65D 77/04* (2006.01)

(52) U.S. Cl.
CPC ..... *B65D 85/36* (2013.01); *B65D 77/046* (2013.01); *B65D 2543/00111* (2013.01); *B65D 2543/0099* (2013.01)

(58) Field of Classification Search
CPC ..... B65D 45/20; B65D 45/30; B65D 2543/00111; B65D 2585/366; B65D 25/2838; B65D 25/2835; B65D 47/32; B65D 45/32; B65D 45/18; B65D 21/086
USPC ..... 220/764, 674, 756, 495.06; 206/551, 206/541, 223, 449–456
See application file for complete search history.

(56) References Cited

U.S. PATENT DOCUMENTS 1,700,824 A * 2/1929 Harden ..... B65D 5/5206 206/45.21
2,220,110 A * 11/1940 Layton ..... B65D 5/2057 206/556
2,789,608 A * 4/1957 Tupper ..... B65D 43/0218 D7/610
5,180,075 A * 1/1993 Montalbano ..... B65D 85/36 229/117.29
6,200,029 B1 * 3/2001 Bonta ..... B65D 81/3897 383/110
6,629,607 B1 * 10/2003 Gibson ..... A45C 11/20 229/906
8,261,938 B2 * 9/2012 Oradini, Sr. ..... B65D 83/08 221/36
10,220,982 B2 * 3/2019 Albers ..... B65D 33/25
10,408,522 B2 * 9/2019 Tsui ..... B65D 21/086
11,325,753 B2 * 5/2022 Johnson ..... B65D 81/3813
11,661,260 B1 * 5/2023 Koenig ..... B65D 77/046 220/23.87
11,738,935 B1 * 8/2023 Koenig ..... B65D 45/30 206/110
12,043,473 B1 * 7/2024 Koenig ..... B65D 45/20
2005/0189253 A1 * 9/2005 Huang ..... B65D 85/48 206/454
2007/0031071 A1 * 2/2007 Perrette ..... B65D 85/34 383/42

(Continued)

*Primary Examiner* — Chun Hoi Cheung

(57) ABSTRACT

A pizza container includes a container body, a lid, and one or more storage bags. The storage bag includes a top wall and a bottom wall, a storage cavity is formed between the top wall and the bottom wall, the storage cavity includes an opening communicated with outside, and a pizza to be stored can be loaded into the storage cavity through the opening. The container body includes a bottom plate and an enclosing wall surrounding the bottom plate, the bottom plate and the enclosing wall enclose a receiving cavity with an open mouth at one end, the receiving cavity is configured to hold the storage bag. The lid is detachably connected to the container body and is configured to seal the open mouth.

19 Claims, 6 Drawing Sheets

(56) References Cited

U.S. PATENT DOCUMENTS

| | | | | |
|---|---|---|---|---|
| 2008/0193058 | A1* | 8/2008 | Rothstein | B65D 33/2508 383/105 |
| 2009/0245698 | A1* | 10/2009 | Miller | B65D 33/2508 383/42 |
| 2016/0059990 | A1* | 3/2016 | Patikas-Bryant | B65D 21/086 220/523 |
| 2018/0118410 | A1* | 5/2018 | Wood | B65D 45/22 |
| 2018/0265263 | A1* | 9/2018 | Li | B65D 43/0202 |
| 2020/0198848 | A1* | 6/2020 | Nahar | B65D 43/0212 |
| 2023/0303291 | A1* | 9/2023 | Oestreicher | B65D 37/00 |
| 2024/0375850 | A1* | 11/2024 | Bruce | B65D 83/0835 |

* cited by examiner

A-A

PIZZA CONTAINER

CROSS-REFERENCE TO RELATED APPLICATIONS

The present disclosure claims priority of the Chinese Patent application No. 202421494278.4 entitled "PIZZA CONTAINER" filed on Jun. 26, 2024 in the China National Intellectual Property Administration, the entire contents of which are incorporated herein by reference.

FIELD OF THE DISCLOSURE

The present disclosure relates to the technical field of food containers, in particular to a pizza container.

DESCRIPTION OF THE RELATED ART

In daily life, there may be a situation where people order pizzas that they can't finish, or when people go out for picnics or parties, they will take away pizzas. Ordinary pizza containers, with their large size, are extremely inconvenient for storing unfinished pizzas or pizzas that need to be taken away.

In order to solve the above problems, the U.S. Pat. No. 111,260B1 discloses a pizza container, which includes a container body, a lid and a tray, each tray holds a slice of pizza, and then a plurality of trays are placed into the container body layer by layer. Although this design can solve a problem that ordinary pizza containers are large in size and inconvenient to carry, a tray on an upper layer of the pizza container is stacked with a pizza on a lower layer of the pizza container, resulting in bottom of the tray on the upper layer sticking to food residues of the pizza, so that when the pizza is removed for heating or consumption, the food residue on the bottom of the tray can stick to a microwave oven tray, a table, or user's hands, which is impossible to be clean and hygienic, and causes trouble to the user.

SUMMARY OF THE DISCLOSURE

In view of this, the present disclosure model provides a pizza container.

The present disclosure provides a pizza container, including:

- one or more storage bags, the storage bag includes a top wall and a bottom wall, a storage cavity is formed between the top wall and the bottom wall, the storage cavity includes an opening communicated with outside, a pizza to be stored can be loaded into the storage cavity through the opening;
- a container body, the container body includes a bottom plate and an enclosing wall surrounding the bottom plate, the bottom plate and the enclosing wall enclose a receiving cavity with an open mouth at one end, the receiving cavity is configured to hold the storage bag; and
- a lid, the lid is detachably connected to the container body and is configured to seal the open mouth.

The pizza container provided in the present disclosure includes a storage bag, the storage bag includes a top wall and a bottom wall. When a pizza to be stored is contained within the storage bag, due to isolation effect of the top wall and the bottom wall, food residues of the pizza in the storage bag will not stick to the storage bag positioned at top of the pizza, the storage bag on bottom of the pizza, and the receiving cavity of the container body. When the user removes the pizza from the pizza container for heating or consumption, the food residue of the pizza will not stick to a microwave oven tray, a table, or the user's hands, which is clean and hygienic, resulting in providing the user a better user experience. Moreover, the user can hold the storage bag with his hand and push the pizza inside the storage bag out of the opening for consumption, without the need to prepare additional gloves, which is very convenient.

BRIEF DESCRIPTION OF THE DRAWINGS

In order to more clearly illustrate the technical solutions of the embodiments of the present disclosure, the following will briefly introduce the accompanying drawings that need to be used in the description of the embodiments. It is obvious that the accompanying drawings in the following description are some of the embodiments of the present disclosure, and for those having ordinary skill in the art, without the exertion of creative labor, other accompanying drawings can be obtained based on these drawings.

DETAILED DESCRIPTION

Figure 1:
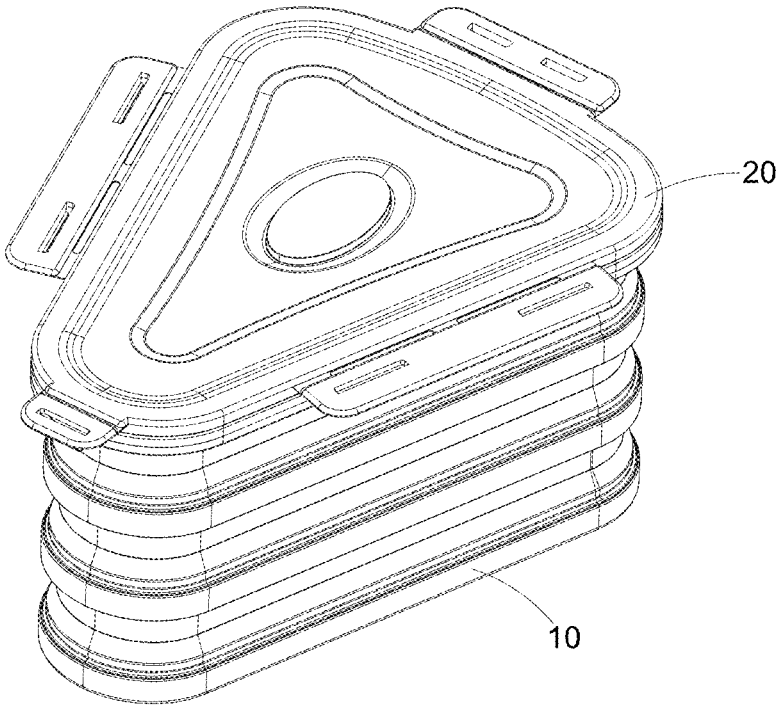
FIG. 1 is a schematic structural diagram of an unfolded state of a pizza container proposed according to one embodiment of the present disclosure.
Figure 2:
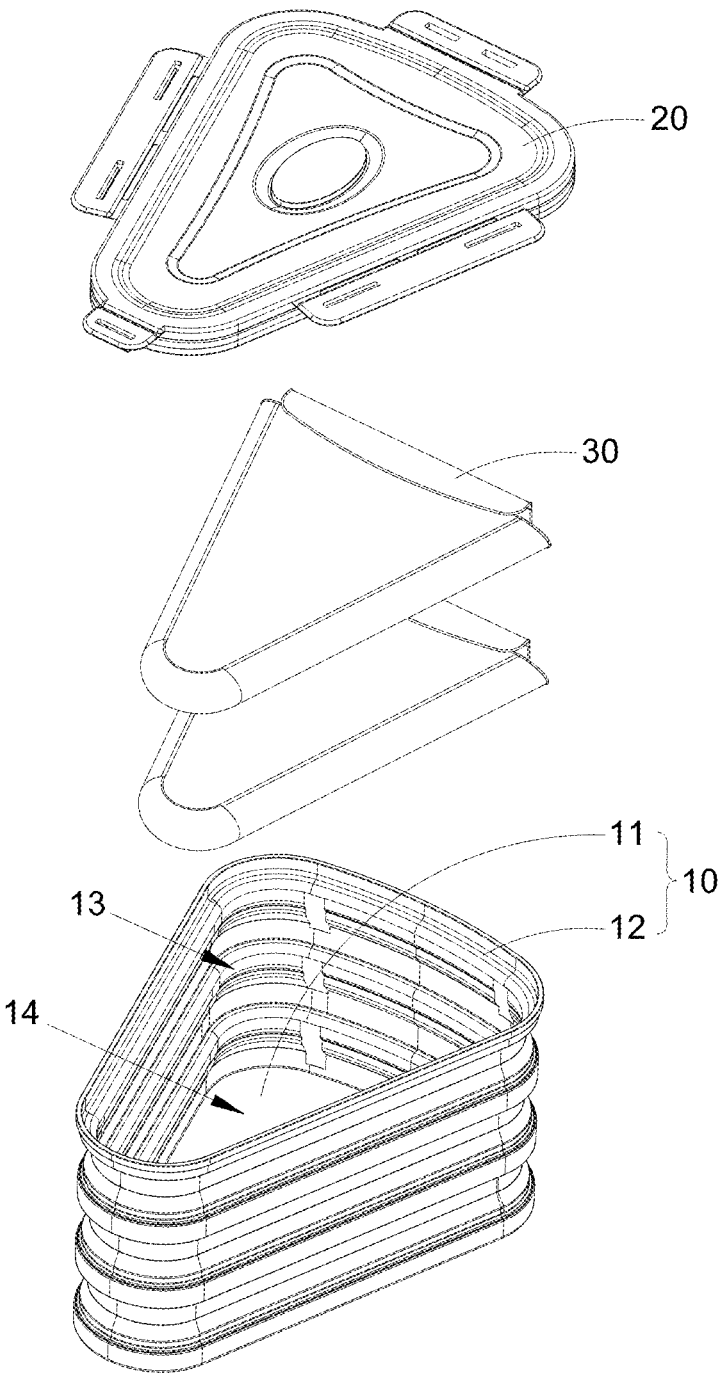
FIG. 2 is an exploded schematic diagram of a pizza container according to one embodiment of the present disclosure.

In the following, technical solutions in embodiments of the present disclosure will be described clearly and completely in conjunction with the accompanying drawings in embodiments of the present disclosure. It is obvious that the embodiments are a part of embodiments of the present disclosure and not all of the embodiments. Based on the embodiments in the present disclosure, other embodiments obtained by those having ordinary skill in the art without making creative labor are within the scope of protection of the present disclosure.

As used in the description of the disclosure concept and the appended claims, the singular forms "a", "an", and "the"

are intended to include the plural forms as well, unless the context clearly indicates otherwise.

As shown in FIG. 1 to FIG. 4, an embodiment of the present disclosure provides a pizza container 100. The pizza container 100 includes a container body 10, a lid 20, and one or more storage bags 30. The storage bag 30 includes a top wall 331 and a bottom wall 332, a storage cavity 31 is formed between the top wall 331 and the bottom wall 332, the storage cavity 31 includes an opening 32 communicated with outside, and a pizza to be stored can be loaded into the storage cavity 31 through the opening 32. The container body 10 includes a bottom plate 11 and an enclosing wall 12 surrounding the bottom plate 11, the bottom plate 11 and the enclosing wall 12 enclose a receiving cavity 14 with an open mouth 13 at one end, the receiving cavity 14 is configured to hold the storage bag 30. The lid 20 is detachably connected to the container body 10 and is configured to seal the open mouth 13.

It should be noted that the top wall 331 and the bottom wall 332 of the storage bag 30 are for an orientation of the storage bag 30 in a normal state of placement. For example, when a plurality of storage bags 30 are stacked into the receiving cavity 14 of the container body 10, a wall above the storage bag 30 is the top wall 331 and a wall below the storage bag 30 is the bottom wall 332.

When a pizza needs to be stored, a user loads the pizza into the storage bag 30 through the opening 32, and then stacks the storage bag 30 containing the pizzas one by one into the receiving cavity 14 of the container body 10, and then covers the lid 20.

The pizza container 100 provided in the present disclosure includes a storage bag 30, the storage bag 30 includes a top wall 331 and a bottom wall 332. When a pizza to be stored is contained within the storage bag 30, due to isolation effect of the top wall 331 and the bottom wall 332, food residues of the pizza in the storage bag 30 will not stick to the storage bag 30 positioned at top of the pizza, the storage bag 30 on bottom of the pizza, and the receiving cavity 14 of the container body 10. When the user removes the pizza from the pizza container 100 for heating or consumption, the food residue of the pizza will not stick to a microwave oven tray, a table, or the user's hands, which is clean and hygienic, resulting in providing the user a better user experience. Moreover, the user can hold the storage bag 30 with his hand and push the pizza inside the storage bag 30 out of the opening 32 for consumption, without the need to prepare additional gloves, which is very convenient.

In some embodiments, the storage bag 30 is a storage bag 30 that is integrally molded using food-grade silicone material. Of course, the storage bag 30 is not limited to being made of silicone material, but may also be made of other materials, such as plastic, glass, and the like, depending on the actual design needs.

In some embodiments, a shape of the container body 10 and a shape of the lid 20 both are triangular with rounded corners at a vertex, the shape is configured to match a substantially triangular shape of existing pizza slices. Of course, in other embodiments, the shape of the container body 10 and the shape of the lid 20 may also be configured as other shapes, such as rectangular, depending on the actual design needs.

In some embodiments, a shape of the storage bag 30 is also substantially triangular. Similarly, the shape is configured to match a substantially triangular shape of existing pizza slices. Likewise, in other embodiments, the shape of the storage bag 30 may also be configured as other shapes, such as rectangular, depending on the actual design needs.

Figure 3:
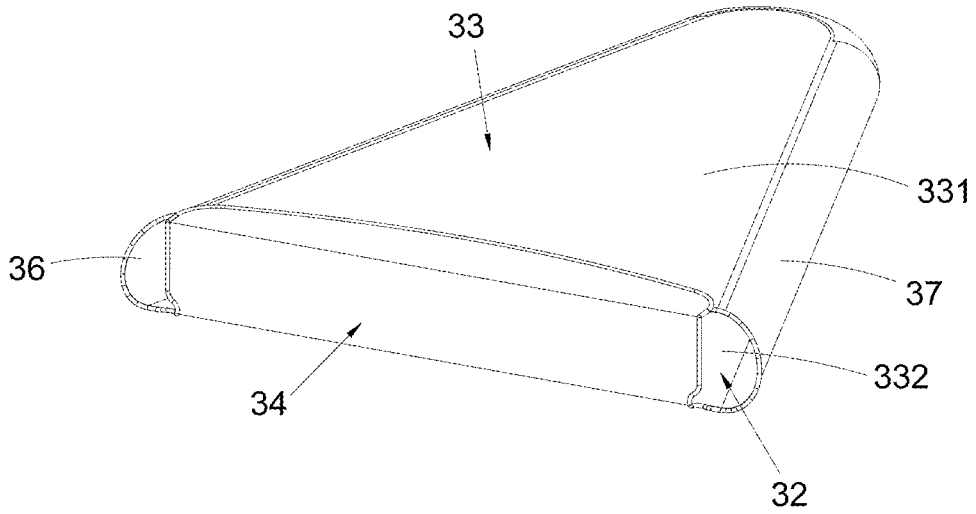
FIG. 3 is a schematic structural diagram of a storage bag according to one embodiment of the present disclosure.
Figure 4:
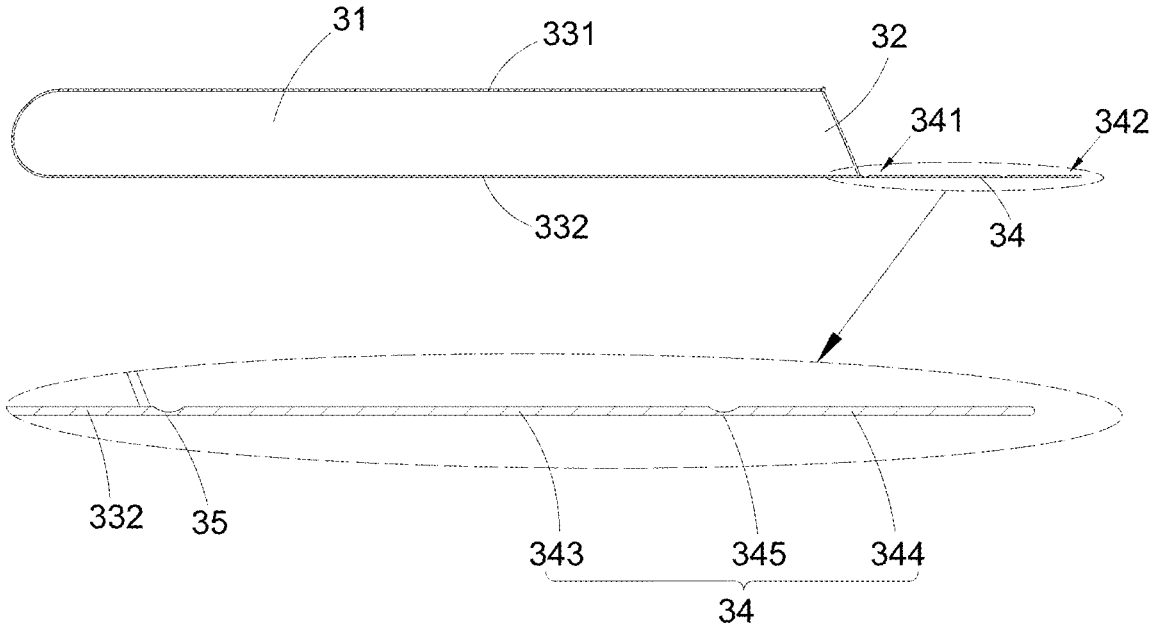
FIG. 4 is a cross-sectional schematic diagram and a partially enlarged diagram in a thickness direction of a storage bag according to one embodiment of the present disclosure.

As shown in FIG. 3 and FIG. 4, in some embodiments, the storage bag 30 further includes a bag cap 34. The bag cap 34 includes a connecting end 341 and a free end 342. The connecting end 341 is pivotally connected to the bottom wall 332, such that the free end 342 can be folded to a side of the top wall 331 opposite the bottom wall 332, the bag cap 34 is configured to cover at least a portion of the opening 32. In the embodiment, by providing the bag cap 34 to cover at least a portion of the opening 32, so that when the pizza container 100 is shaken, the pizza in the storage bag 30 will not fall out of the opening 32 resulting in oil stains on the pizza sticking to a side wall of the container body 10, making the storage of the pizza clean and hygienic.

As shown in FIG. 4, in some embodiments, the connecting end 341 of the bag cap 34 is connected to the bottom wall 332 of the storage bag 30 through a first connecting portion 35. A thickness of the first connecting portion 35 is less than a thickness of the connecting end 341 and a thickness of the bottom wall 332, so as to make the connecting end 341 foldable relative to the bottom wall 332. In the embodiment, by providing the first connecting portion 35 with a smaller thickness, the stress on the connecting end 341 of the bag cap 34 when it is folded relative to the bottom wall 332 is smaller, so that the bag cap 34 is easy to be folded and is not easy to be automatically flipped back down.

As shown in FIG. 4, in some embodiments, the bag cap 34 includes a first shielding portion 343, a second shielding portion 344, and a second connecting portion 345. The first shielding portion 343 is connected to the second shielding portion 344 through the second connecting portion 345. An end of the first shielding portion 343 far from the second connecting portion 345 is the connecting end 341, and an end of the second shielding portion 344 far from the second connecting portion 345 is the free end 342. A thickness of the second connecting portion 345 is less than a thickness of the first shielding portion 343 and a thickness of the second shielding portion 344, making the second shielding portion 344 foldable relative to the first shielding portion 343. In the embodiment, by providing the second connecting portion 345 with a smaller thickness, the stress on the first shielding portion 343 and the second shielding portion 344 when they are folded is smaller, so that the second shielding portion 344 can be better lapped onto the top wall 331.

Figure 5:
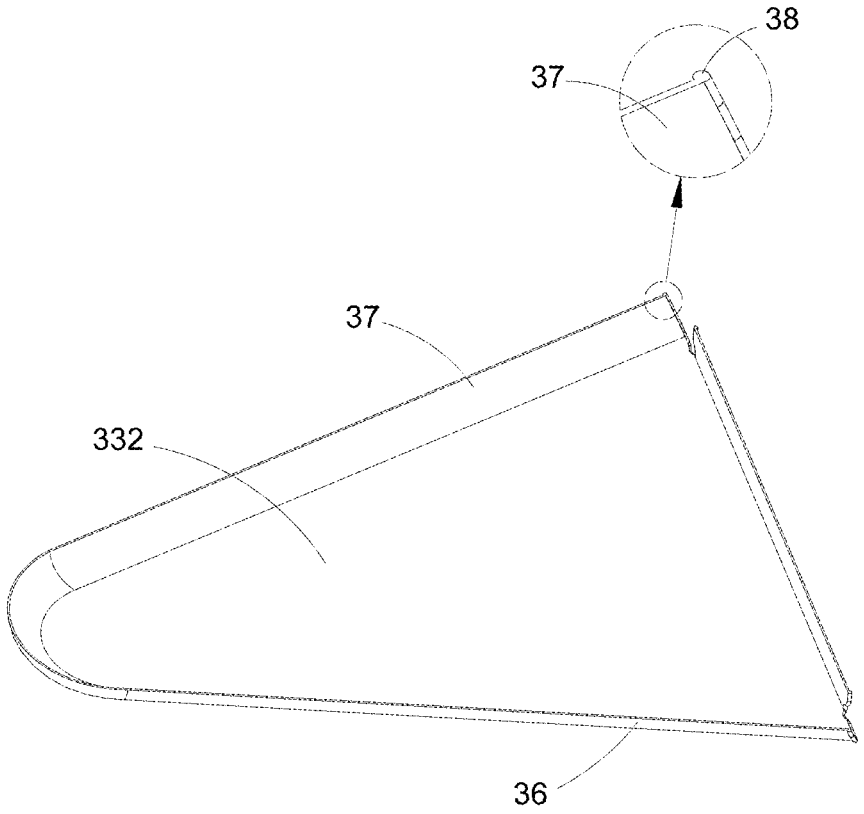
FIG. 5 is a cross-sectional schematic diagram and a partially enlarged diagram in a horizontal direction of a storage bag according to one embodiment of the present disclosure.

As shown in FIG. 3 and FIG. 5, in some embodiments, the storage bag 30 further includes a first side wall 36 and a second side wall 37. The first side wall 36 and the second side wall 37 are disposed on opposing sides of the top wall 331. The first side wall 36 is connected to the top wall 331 and the bottom wall 332, the second side wall 37 is connected to the top wall 331 and the bottom wall 332. An end portion of the bottom wall 332, an end portion of the top wall 331, an end portion of the first side wall 36, and an end portion of the second side wall 37 enclose the opening 32. Wherein the end portion of the first side wall 36 and/or the end portion of the second side wall 37 are provided with a reinforcing structure 38, so that the end portion of the first side wall 36 and/or the end portion of the second side wall 37 can be maintained in an open state when the storage bag 30 is placed flat. In the embodiment, by providing the reinforcing structure 38 at the end portion of the first side wall 36 and/or the end portion of the second side wall 37, the end portion of the first side wall 36 and/or the end portion of the second side wall 37 can be maintained in an open state when the storage bag 30 is placed flat. Thus a user can conveniently open the top wall 331 and the bottom wall 332 of the storage bag 30 at the end portion of the first side wall 36 or at the end portion of the second side wall 37. It can be understood that if the end portion of the first side wall 36 and/or the end portion of the second side wall 37 is not provided with a reinforcing structure 38, when the storage bag 30 is placed flat, the openings 32 of the storage bag 30 may all be in a sticky closed state, making it impossible for the user to easily open the top wall 331 and the bottom wall 332 of the storage bag 30.

In some embodiments, the reinforcing structure 38 is a rib provided at the end portion of the first side wall 36 and/or the end portion of the second side wall 37. It is noted that the reinforcing structure 38 is not limited to being configured as a rib, for example, in some other embodiments, the end portion of the first side wall 36 and/or the end portion of the second side wall 37 can be integrally thickened to form the reinforcing structure 38, so that the end portion of the first side wall 36 and/or the end portion of the second side wall 37 may be maintained in an open state when the storage bag 30 is placed flat.

In some embodiments, the free end 342 of the bag cap 34 is provided with a first connecting structure (not shown in the figure), and a side of the top wall 331 facing away from the bottom wall 332 is provided with a second connecting structure (not shown in the figure). The free end 342 of the bag cap 34 is connected to the top wall 331 through the first connecting structure and the second connecting structure. In the embodiment, when the pizza container 100 is shaken, the bag cap 34 will not automatically open, which can prevent the pizza in the storage bag 30 from falling out.

In some embodiments, one of the first connecting structure and the second connecting structure is a male clasp, the other of the first connecting structure and the second connecting structure is a female clasp. The first connecting structure and the second connecting structure are snap-connected. The male clasp and the female clasp may be, but are not limited to, a self-sealing strip, a clasp structure.

Figure 6:
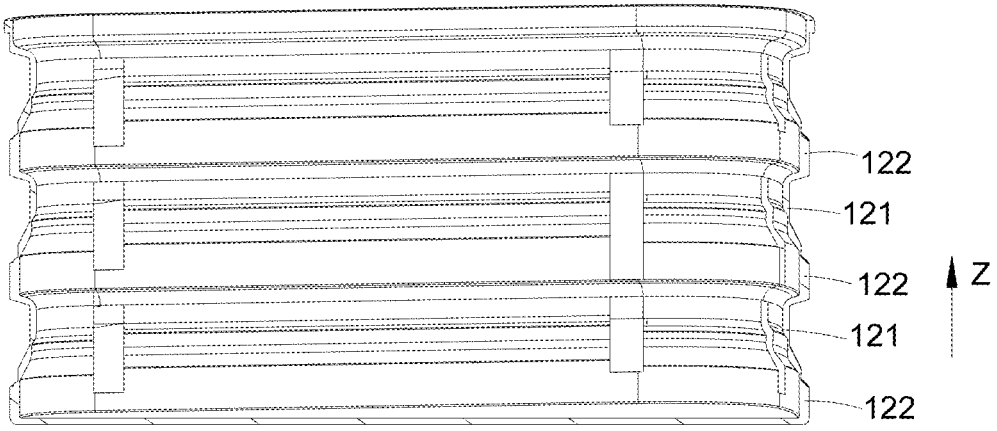
FIG. 6 is a cross-sectional schematic diagram of a container body according to one embodiment of the present disclosure.
Figure 7:
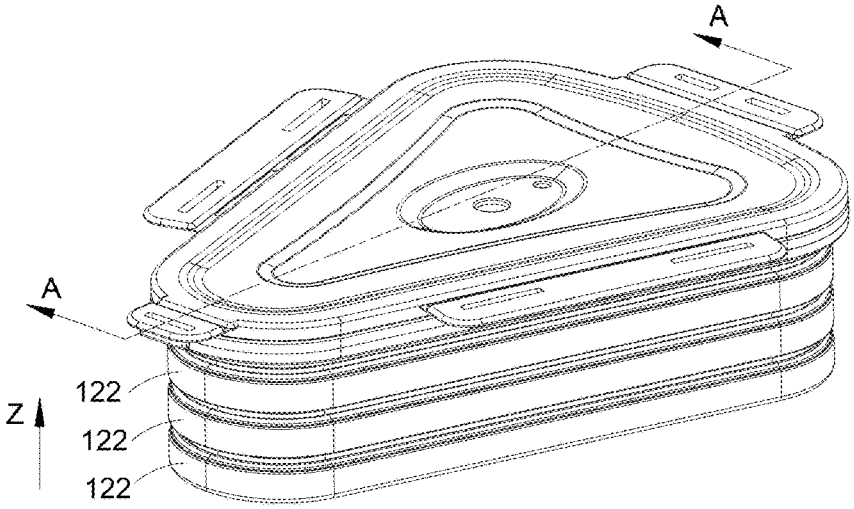
FIG. 7 is a schematic structural diagram of a folded state of a pizza container according to one embodiment of the present disclosure.
Figure 8:
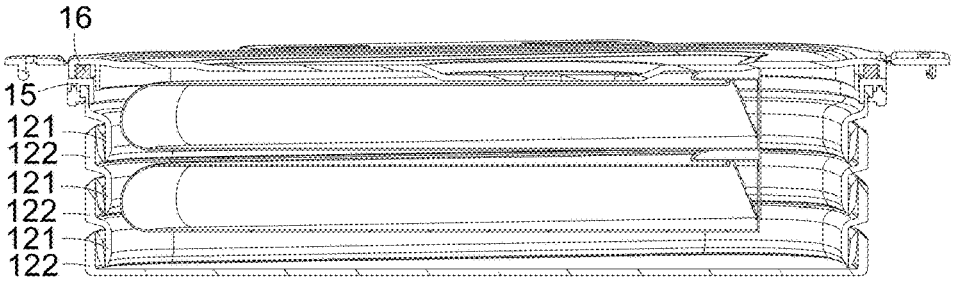
FIG. 8 is a cross-sectional schematic diagram at section A-A in FIG. 7.

As shown in FIG. 6 to FIG. 8, in some embodiments, the enclosing wall 12 includes a flexible folding portion 121 and at least two annular portions 122. At least two annular portions 122 are arranged along a thickness direction Z of the container body 10. Two adjacent annular portions 122 are connected to each other through the flexible folding portion 121, so that the enclosing wall 12 includes folded state and unfolded state. When the enclosing wall 12 is in the folded state, at least two annular portions 122 are stacked in the thickness direction Z of the container body 10. In the embodiment, by providing the enclosing wall 12 of the container body 10 to be foldable, when the pizza container 100 is not in use, the container body 10 can be folded, resulting in making the pizza container 100 smaller and easier to store. At the same time, this folding method makes the pizza container 100 in the unfolded state have higher stability compared to a pizza container disclosed in U.S. Pat. No. 111,260B1, and avoids a defect of a pizza container in the unfolded state disclosed in U.S. Pat. No. 111,260B1 being top-heavy due to a structure of a small bottom and a large top.

As shown in FIG. 8, in some embodiments, the container body 10 further includes an annular member 15 and a sealing ring 16. The annular member 15 is arranged at an opening end of the enclosing wall 12, the lid 20 is detachably connected to the annular member 15. The sealing ring 16 is arranged at a side of the annular member 15 facing away from the bottom plate 11, the sealing ring 16 is configured to form a seal between the annular member 15 and the lid 20. In the embodiment, by providing the sealing ring 16 to form a seal between the annular member 15 and the lid 20, when the pizza container 100 storing a pizza is placed in a refrigerator for storage, odor of the pizza can be prevented from emitting to interior of the refrigerator, and odor of other food products in the interior of the refrigerator can be prevented from intruding into the pizza container 100. In some embodiments, the annular member 15 is a rigid member, the sealing ring 16 is molded by a secondary injection molding process on a side of the annular member 15 facing away from the bottom plate 11.

Figure 9:
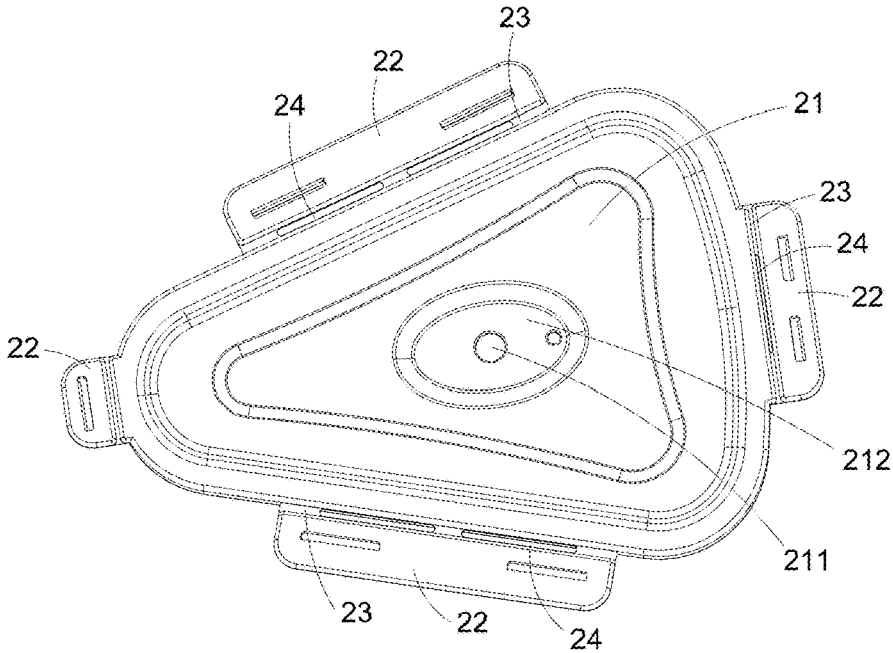
FIG. 9 is a schematic structural diagram of a lid according to one embodiment of the present disclosure.

As shown in FIG. 9, in some embodiments, the lid 20 includes a lid body 21 and a plurality of claw clasps 22, the plurality of claw clasps 22 are arranged at intervals around the lid body 21, each of the claw clasps 22 is foldably connected to the lid body 21 through a third connecting portion 23. Wherein at least one the third connection portion 23 is provided with a hollow structure 24. In the embodiment, by providing the third connection portions 23 with a hollow structure 24, the stress of the claw clasps 22 when it is folded can be reduced, which makes process of closing the lid 20 more labor-saving.

Figure 10:
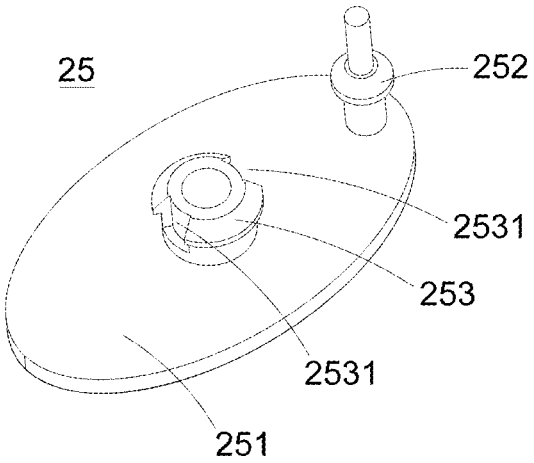
FIG. 10 is a schematic structural diagram of a sealing cover according to one embodiment of the present disclosure.

As shown in FIG. 9 and FIG. 10, in some embodiments, the lid body 21 is provided with a vent hole 211, the lid 20 further includes a sealing cover 25 which is openably and closably connected to the lid body 21, the sealing cover 25 is configured to seal the vent hole 211.

As shown in FIG. 10, in some embodiments, the sealing cover 25 includes a main body portion 251, a flexible portion 252, and a sealing portion 253. The flexible portion 252 is connected to the main body portion 251 and mounted on the lid body 21, the sealing portion 253 is connected to the main body portion 251, the sealing portion 253 is configured to seal the vent hole 211. Wherein the sealing portion 253 is a tubular structure with a hole provided in the middle. In the embodiment, by providing the sealing portion 253 as a tubular structure with a hole in the middle, when the sealing portion 253 is embedded into the vent hole 211 to seal the vent hole 211, the sealing portion 253 is prone to deformation to reduce its volume, thereby making the sealing portion 253 more labor-saving to embed the sealing portion 253 into the vent hole 211.

As shown in FIG. 10, in some embodiments, recesses 2531 are arranged on opposite sides of the sealing portion 253. In the embodiment, when the sealing portion 253 is embedded into the vent hole 211 to seal the vent hole 211, the sealing portion 253 is prone to deformation to reduce its volume, thereby making the sealing portion 253 more labor-saving to embed the sealing portion 253 into the vent hole 211.

Figure 11:
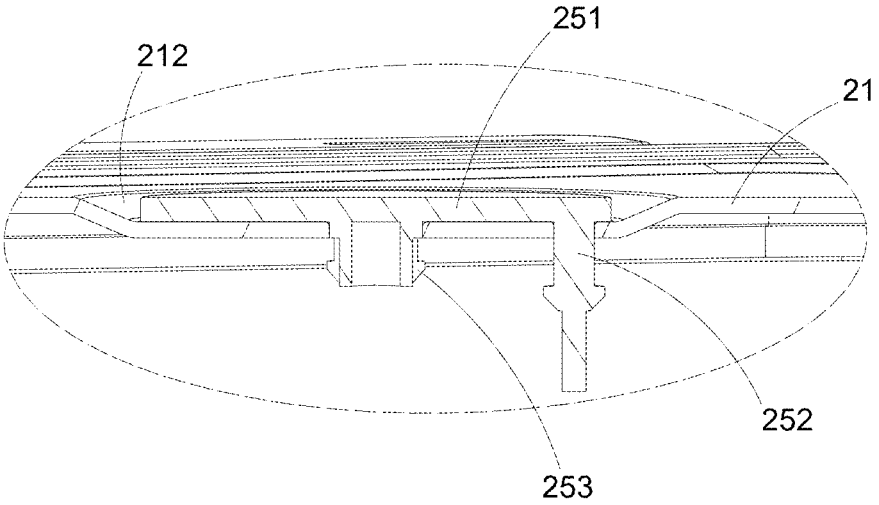
FIG. 11 is a schematic diagram illustrating the fit of a lid and a sealing cover according to one embodiment of the present disclosure.

As shown in FIG. 9 and FIG. 11, in some embodiments, the lid body 21 is recessed toward the receiving cavity 14 to form a recessed portion 212, the sealing cover 25 is located in the recessed portion 212, a surface of the sealing cover 25 which is away from the receiving cavity 14 is flush with an outer surface of the lid body 21. In the embodiment, overall appearance of the pizza container 100 is more consistent, simple and beautiful. Of course, it is also possible to provide the sealing cover 25 protruding from the outer surface of the lid body 21, depending on the actual design needs.

The above description is only a specific embodiment of the present disclosure, but the protection scope of the present disclosure is not limited thereto. Any person having ordinary skill in the art familiar with the technical field can easily think of various equivalent modifications or replacements within the technical scope disclosed by the present disclosure, these modifications or replacements should be included within the protection scope of the present disclosure. Therefore, the protection scope of the present disclosure should be determined by the protection scope of the claims.

What is claimed is:

1. A pizza container, comprising:

one or more storage bags, the storage bag includes a top wall and a bottom wall, a storage cavity is formed between the top wall and the bottom wall, the storage cavity includes an opening communicated with outside, a pizza to be stored can be loaded into the storage cavity through the opening;

a container body, the container body includes a bottom plate and an enclosing wall surrounding the bottom plate, the bottom plate and the enclosing wall enclose a receiving cavity with an open mouth at one end, the receiving cavity is configured to hold the storage bag; and a lid, the lid is detachably connected to the container body and is configured to seal the open mouth;

wherein the storage bag further includes a first side wall and a second side wall, the first side wall and the second side wall are disposed on opposing sides of the top wall, the first side wall is connected to the top wall and the bottom wall, the second side wall is connected to the top wall and the bottom wall; an end portion of the bottom wall, an end portion of the top wall, an end portion of the first side wall, and an end portion of the second side wall enclose the opening;

wherein the end portion of the first side wall or the end portion of the second side wall are provided with a reinforcing structure, resulting in the end portion of the first side wall or the end portion of the second side wall being maintained in an open state when the storage bag is placed flat.

2. The pizza container according to claim 1, wherein the storage bag further includes:

a bag cap, the bag cap includes a connecting end and a free end, the connecting end is pivotally connected to the bottom wall, resulting in the free end being folded to a side of the top wall opposite the bottom wall, the bag cap is configured to cover at least a portion of the opening.

3. The pizza container according to claim 2, wherein the connecting end of the bag cap is connected to the bottom wall of the storage bag through a first connecting portion, a thickness of the first connecting portion is less than a thickness of the connecting end and a thickness of the bottom wall, resulting in making the connecting end foldable relative to the bottom wall.

4. The pizza container according to claim 2, wherein the bag cap includes a first shielding portion, a second shielding portion, and a second connecting portion; the first shielding portion is connected to the second shielding portion through the second connecting portion, an end of the first shielding portion far from the second connecting portion is the connecting end, an end of the second shielding portion far from the second connecting portion is the free end;

a thickness of the second connecting portion is less than a thickness of the first shielding portion and a thickness of the second shielding portion, making the second shielding portion foldable relative to the first shielding portion.

5. The pizza container according to claim 2, wherein the free end of the bag cap is provided with a first connecting structure, a side of the top wall facing away from the bottom wall is provided with a second connecting structure, the free end of the bag cap is connected to the top wall through the first connecting structure and the second connecting structure.

6. The pizza container according to claim 5, wherein one of the first connecting structure and the second connecting structure is a male clasp, the other of the first connecting structure and the second connecting structure is a female clasp, the first connecting structure and the second connecting structure are snap-connected.

7. The pizza container according to claim 1, wherein the enclosing wall includes:

a flexible folding portion; and at least two annular portions, the at least two annular portions are arranged along a thickness direction of the container body, two adjacent annular portions are connected to each other through the flexible folding portion, resulting in the enclosing wall including folded state and unfolded state, wherein, when the enclosing wall is in the folded state, the at least two annular portions are stacked in the thickness direction of the container body.

8. The pizza container according to claim 1, wherein the container body further includes an annular member and a sealing ring, the annular member is arranged at an opening end of the enclosing wall, the lid is detachably connected to the annular member, the sealing ring is arranged at a side of the annular member facing away from the bottom plate, the sealing ring is configured to form a seal between the annular member and the lid.

9. The pizza container according to claim 8, wherein the annular member is a rigid member, the sealing ring is molded by a secondary injection molding process on a side of the annular member facing away from the bottom plate.

10. The pizza container according to claim 1, wherein the lid includes:

a lid body; and a plurality of claw clasps, the plurality of claw clasps are arranged at intervals around the lid body, each of the claw clasps is foldably connected to the lid body through a third connecting portion;

wherein at least one the third connection portion is provided with a hollow structure.

11. The pizza container according to claim 10, wherein the lid body is provided with a vent hole, the lid further includes a sealing cover which is openably and closably connected to the lid body, the sealing cover is configured to seal the vent hole.

12. The pizza container according to claim 11, wherein the sealing cover includes:

a main body portion;

a flexible portion, the flexible portion is connected to the main body portion and mounted on the lid body; and a sealing portion, the sealing portion is connected to the main body portion, the sealing portion is configured to seal the vent hole;

wherein the sealing portion is a tubular structure with a hole provided in the middle.

13. The pizza container according to claim 12, wherein recesses are arranged on opposite sides of the sealing portion.

14. The pizza container according to claim 11, wherein the lid body is recessed toward the receiving cavity to form a recessed portion, the sealing cover is located in the recessed portion, a surface of the sealing cover which is away from the receiving cavity is flush with an outer surface of the lid body.

15. The pizza container according to claim 11, wherein the sealing cover protrudes from an outer surface of the lid body.

16. The pizza container according to claim 1, wherein the storage bag is a storage bag that is integrally molded using food-grade silicone material; or a shape of the container body and a shape of the lid both are triangular with rounded corners at a vertex.

17. The pizza container according to claim 1, wherein a shape of the storage bag is also substantially triangular.

18. A pizza container, comprising:

one or more storage bags, the storage bag includes a top wall and a bottom wall, a storage cavity is formed between the top wall and the bottom wall, the storage cavity includes an opening communicated with outside, a pizza to be stored can be loaded into the storage cavity through the opening;

a container body, the container body includes a bottom plate and an enclosing wall surrounding the bottom plate, the bottom plate and the enclosing wall enclose a receiving cavity with an open mouth at one end, the receiving cavity is configured to hold the storage bag;

a lid, the lid is detachably connected to the container body and is configured to seal the open mouth; and wherein the storage bag includes a first side wall and a second side wall, a reinforcing structure is a rib provided at an end portion of the first side wall or an end portion of the second side wall.

19. A pizza container, comprising:

one or more storage bags, the storage bag includes a top wall and a bottom wall, a storage cavity is formed between the top wall and the bottom wall, the storage cavity includes an opening communicated with outside, a pizza to be stored can be loaded into the storage cavity through the opening;

a container body, the container body includes a bottom plate and an enclosing wall surrounding the bottom plate, the bottom plate and the enclosing wall enclose a receiving cavity with an open mouth at one end, the receiving cavity is configured to hold the storage bag;

a lid, the lid is detachably connected to the container body and is configured to seal the open mouth; and wherein the storage bag includes a first side wall and a second side wall, an end portion of the first side wall or an end portion of the second side wall is integrally thickened to form a reinforcing structure.

* * * * *